US005963985A

United States Patent [19]

Behr et al.

[11] Patent Number: 5,963,985

[45] Date of Patent: Oct. 12, 1999

[54] LACROSSE THUMB PROTECTOR

[75] Inventors: Rojiro Robert Behr; Robert Davies Behr, both of Chestertown, Md.

[73] Assignee: Rojiro Robert Behr, Chestertown, Md.

[21] Appl. No.: 09/195,124

[22] Filed: Nov. 18, 1998

[51] Int. Cl.[6] ..... A41D 19/00

[52] U.S. Cl. ..... 2/21; 2/161.1

[58] Field of Search ..... 2/21, 159, 160, 2/161.1, 163, 19

[56] References Cited

U.S. PATENT DOCUMENTS

| | | | |
|---|---|---|---|
| D. 332,845 | 1/1993 | Johnston | D29/22 |
| D. 346,046 | 4/1994 | Guilbault | D29/22 |
| D. 357,093 | 4/1995 | Labitan | D29/113 |
| D. 376,676 | 12/1996 | Chen | D29/117 |
| D. 379,677 | 6/1997 | Castonguay | D29/117 |
| D. 387,505 | 12/1997 | Clement | D29/117 |
| 617,929 | 1/1899 | Fowble | 2/21 |
| 932,901 | 8/1909 | Ramsey | 2/21 |
| 1,916,921 | 7/1933 | Dougan | 2/21 |
| 2,323,854 | 7/1943 | Silverman | 2/21 |
| 2,461,970 | 2/1949 | Finegan | 2/21 |
| 3,605,117 | 9/1971 | Latina | 2/16 |
| 3,626,515 | 12/1971 | Murray | 2/16 |
| 3,728,736 | 4/1973 | Pugh | 2/21 |
| 3,945,045 | 3/1976 | Rhee | 2/16 |
| 4,089,066 | 5/1978 | Dethman | 2/21 |
| 4,137,572 | 2/1979 | Jansson et al. | 2/161 R |
| 4,272,849 | 6/1981 | Thurston et al. | 2/161 R |
| 4,290,147 | 9/1981 | Bruckner | 2/18 |
| 4,438,532 | 3/1984 | Campanella et al. | 2/16 |
| 4,653,490 | 3/1987 | Eisenberg | 128/133 |
| 4,694,508 | 9/1987 | Iriyama et al. | 2/21 |
| 4,796,302 | 1/1989 | Davis et al. | 2/21 |
| 4,930,162 | 6/1990 | Cote | 2/161 A |
| 4,995,119 | 2/1991 | Codkind | 2/163 |
| 5,031,239 | 7/1991 | Panichello et al. | 2/21 |
| 5,063,613 | 11/1991 | Brown | 2/21 |
| 5,067,175 | 11/1991 | Gold | 2/161 R |
| 5,093,933 | 3/1992 | Berry | 2/161 R |
| 5,237,703 | 8/1993 | Brine et al. | 2/163 |
| 5,450,626 | 9/1995 | Sorrels | 2/21 |
| 5,488,739 | 2/1996 | Cardinal | 2/161.1 |
| 5,511,242 | 4/1996 | Bianchi | 2/16 |
| 5,527,244 | 6/1996 | Waller et al. | 482/47 |
| 5,528,772 | 6/1996 | Cheek | 2/161.1 |
| 5,613,938 | 3/1997 | Kaiser et al. | 2/21 |
| 5,682,611 | 11/1997 | Kline | 2/160 |
| 5,745,916 | 5/1998 | Linner | 2/16 |
| 5,749,097 | 5/1998 | Garrett-Roe | 2/21 |

*Primary Examiner*—John J. Calvert
*Assistant Examiner*—Tejash D Patel
*Attorney, Agent, or Firm*—Pollock, Vande Sande & Amernick

[57] ABSTRACT

A thumb protector for preventing injury to players in such sports as lacrosse and hockey. The thumb protector comprises a rigid cap covering the end of the thumb when in use, and being supported by a rigid support member connecting the cap and a base, the base engaging the root of the thumb when in use, or being anchored to a protective glove.

15 Claims, 6 Drawing Sheets

LACROSSE THUMB PROTECTOR

FIELD OF THE INVENTION

The invention relates to protective gear for use in such sports as lacrosse or hockey.

BACKGROUND OF THE INVENTION

The invention is directed to a thumb protector as an integral part of a lacrosse protective glove or other type of sports glove, or for use as a separate appliance in conjunction with a protective glove.

In contact sports, such as lacrosse, hockey, etc., protective gear is necessary to protect players from the impact of hand-held sticks and hard objects such as the puck in hockey or the hard solid rubber ball in lacrosse. Padded gloves, for instance, may be used to protect the hands against stick strikes and other severe impacts such as impact from a ball. The goalie in lacrosse, for example, because of the manner in which he must hold his stick in order to protect the goal, is especially vulnerable to impact to the tip of his thumb from a ball which is driven toward him as the result of an attacking shot on the goal. Such impact, wherein the force of impact is in a direction substantially parallel to a longitudinal axis of the thumb, is not adequately protected against by the current state of the art. Consequently, injuries such as a broken, split, or fractured thumb commonly result. Prior art protective gear designed to prevent hand injuries typically comprises a glove with finger stalls for the individual fingers of the hand and impact-protective padding, and may utilize rigid, impact-resistant elements as additional protection. However, nothing in the prior art appears to address the prevention of the kind of injuries to the thumb described above.

Rigid or stiffening protective elements incorporated into gloves to protect the digits of the hand have been described in the prior art. Typical of thumb protective structures are those disclosed in U.S. Pat. No. 3,626,515 to Murray. Murray describes a protector for the back of a hockey glove including a thumb guard made of a rigid material. The thumb guard resembles a flattened shell and extends over a back portion of the thumb from the wrist to the tip of the thumb without anywhere enclosing the thumb. With this arrangement, while the side of the thumb is protected, coverage by the rigid material does not extend to the tip of the thumb, leaving it exposed to blows directed along an axis substantially parallel to a longitudinal axis of the thumb.

A second example of prior art concerned with thumb protection is shown in U.S. Pat. No. 4,137,572 to Jansson et al. Jansson et al. describe a protective glove including thumb protection comprising a protective strip of hard and relatively stiff material incorporated into padding in the glove along the outer side of the thumb. The protective strip extends from the top of the thumb along an outside region of the thumb to a cuff of the protective glove located in the wrist area. The protective strip is relatively thin and flat and, as such, is adapted as reinforcement for the associated padding, rather than acting to directly protect the thumb from impact, or, more particularly, from impact to the tip of the thumb directed along an axis substantially parallel to a longitudinal axis of the thumb.

U.S. Pat. No. 5,237,703 to Brine et al. discloses a protective athletic glove for contact stick sports. The invention includes a thumb protector constructed of a stiff, impact-resistant material. The thumb protector includes two jointed segments resembling a flattened shell and overlying the outside of the thumb without anywhere enclosing the thumb.

In particular, coverage by the impact-resistant material does not extend to the tip of the thumb, leaving it exposed to blows directed along an axis substantially parallel to a longitudinal axis of the thumb.

Other prior art devices are similar to those discussed above in that they provide thumb protection comprising a rigid material cupping, or overlying, the outer part of the thumb without anywhere enclosing the thumb. Coverage by the rigid material does not extend to the tip of the thumb, leaving it exposed to blows directed along an axis substantially parallel to a longitudinal axis of the thumb. Thus, nothing in the prior art appears to address the specific injury discussed earlier, wherein, in particular, goalies in a lacrosse game are especially vulnerable to impact to the tips of their thumbs as they attempt to protect the goal.

OBJECTS OF THE INVENTION

It is an object of the present invention to provide thumb protection which is specifically directed to protecting a goalie from injury from a blow directed along an axis substantially parallel to a longitudinal axis of the thumb.

It is a further object of the present invention to provide such thumb protection in a form which may be either incorporated into a glove or, alternatively, be employed as a separate appliance to be used in conjunction with a protective glove.

Still other objects and advantages of the present invention become readily apparent to those skilled in the art from the following detailed description, wherein only the preferred embodiments of the invention are described, simply by way of illustration of the best mode contemplated of carrying out the invention. As will be realized, the invention is capable of other and different embodiments, and its several details are capable of modifications in various respects, without departing from the invention. Accordingly, the drawings and description are to be regarded as illustrative. SUMMARY OF THE INVENTION The invention is directed to a thumb protector for preventing injuries of the kind typically suffered by the goalie in lacrosse. In one embodiment the thumb protector comprises a rigid cap covering the end of the thumb when in use, and being supported by a rigid support member connecting the cap and a base, the base engaging the root of the thumb when in use, or being anchored to a glove to absorb shock directed to the tip of the thumb in a direction substantially parallel to a longitudinal axis of the thumb. The thumb protector may further include a sheath or sleeve of flexible material, such as cloth, extending between the cap and the base to retain the thumb within the protection of the cap.

With this structure, the thumb protector is particularly adapted to prevent injuries to the tip of the thumb occasioned by impact such as is typically incurred from a ball driven toward the lacrosse goal while the goalie is defending the goal. The cap covering the tip of the thumb deflects impact, while the support member transfers the shock of impact to the base, where it may be absorbed by the hand, glove or palm without injury.

BRIEF DESCRIPTION OF THE DRAWINGS

The present invention will be more clearly understood when considered in conjunction with the accompanying drawings, in which.

DESCRIPTION OF PREFERRED EMBODIMENTS

Figure 1:
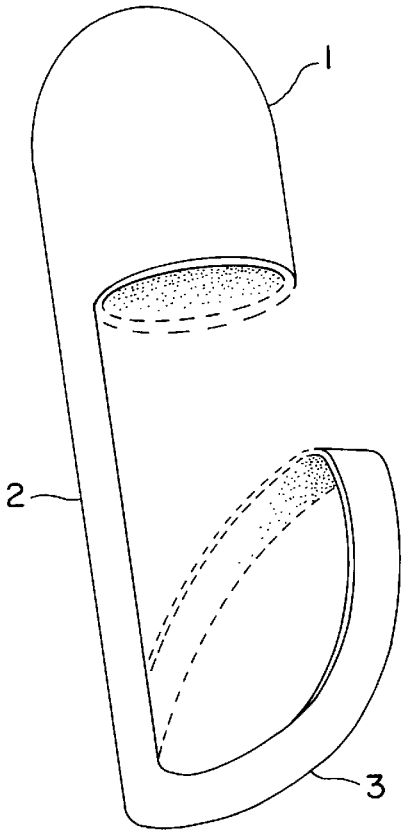
FIG. 1 is an isometric view of one embodiment of the invention.

Turning now to FIG. 1, there is shown an embodiment of the present invention comprising a cap 1, a cap support 2, and a base 3. The cap 1 comprises a rigid shell shaped like a domed or covered cylinder and extending, when in use, above the top of the thumb and extending for 360° about an extension of the longitudinal axis of the thumb. The cap support 2 is connected between the base and the cap and is positioned along the outside of the thumb when in use. The cap support 2 is a relatively thin rod-type structure or member abutting the cap 1 at a point on the outer circumference of the cap 1 where it opens to surround the tip of the thumb when in use. The cap support 2, when in use, abuts the base 3 at a point approximately located behind the lower knuckle of the thumb. In the embodiment shown in FIG. 1, the base 3 is adapted to engage the hand adjacent the root of the thumb and has the form of a closed loop which, when in use, surrounds the root of the thumb. In use, the base 3 is located and maintained in position by the presence of the thumb. As a result, even though the user may manipulate the hand on which the thumb protector is mounted, the base maintains the thumb protector in position to protect the tip of the thumb.

Figure 2:
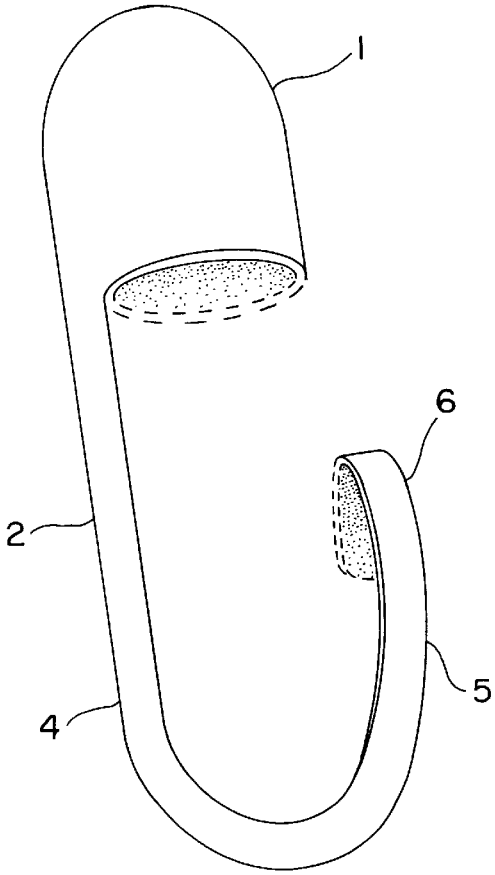
FIG. 2 is an isometric view of a second embodiment of the invention showing a variation in the structure of the base.

Turning now to FIG. 2, a second preferred embodiment of the invention is shown comprising a cap 1 and a cap support 2 as in the first-described embodiment, but having a base which is of U-shape, having a first leg 4 and a second leg 5, with the first leg 4 of the U merging with and being co-extensive with the cap support 2, and the second leg 5 of the U terminating in a hook-like structure 6. When in use, the first leg 4, lower curve of the U and second leg 5 abut the back of the hand, while the hook-like terminal 6 of the second leg 5 engages the hand near the interphalangeal joint adjacent the root of the thumb and terminates where it abuts the palm of the hand. While the base 4–6 in FIG. 2 is different from the base 3 of FIG. 1, nevertheless, the base 4–6 performs substantially the same function as the base 3. Both bases locate and maintain the thumb protector in proper position, and absorb shock, transferred along the cap support 2, from a blow directed at the tip of the thumb. The shock is then further transferred and absorbed at the base of the thumb through the cushion of the interphalangeal joint.

Figure 3:
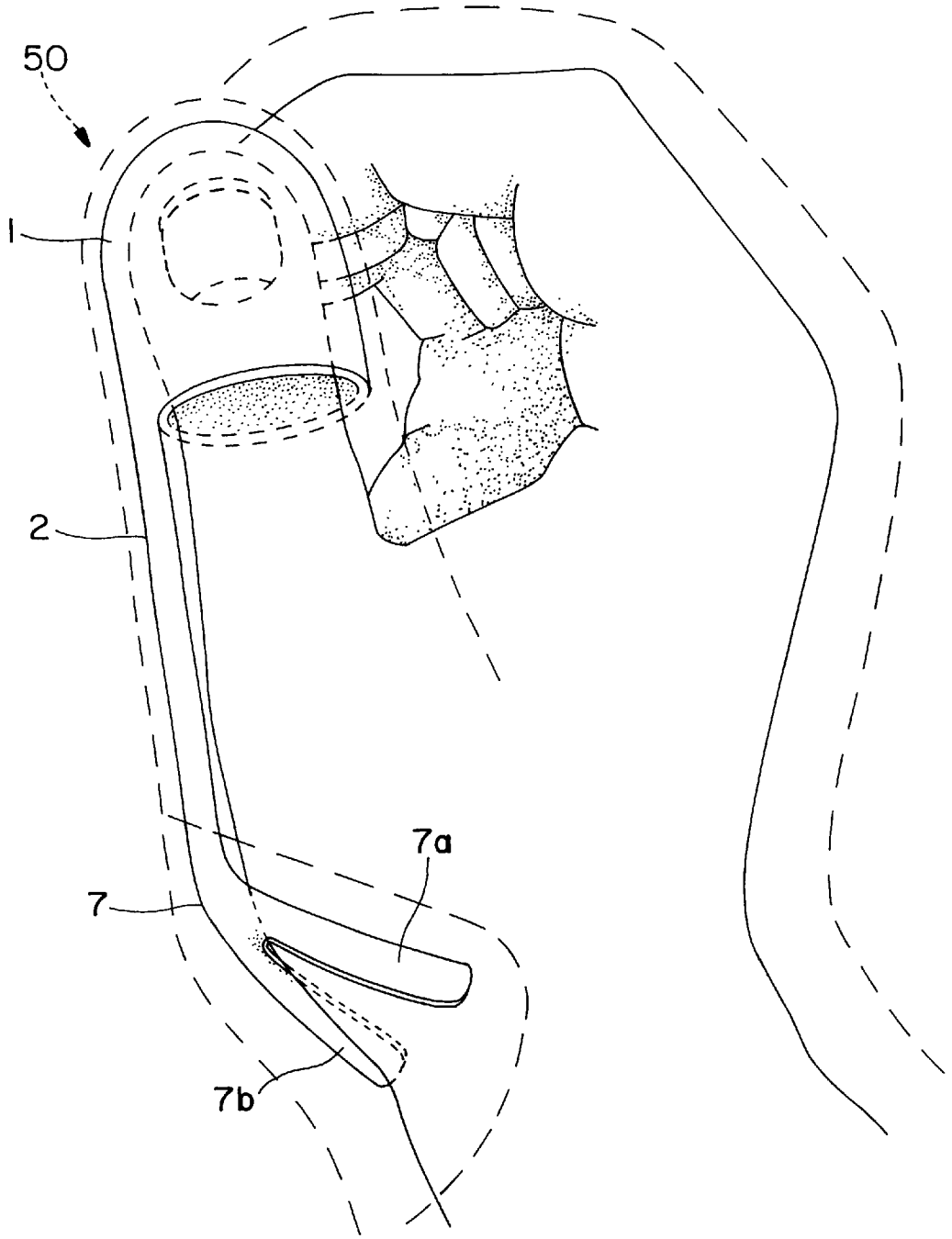
FIG. 3 is a composite view of an embodiment of the invention adapted to be incorporated into a glove.

The foregoing embodiments may be either incorporated into a glove structure or worn separately, in conjunction with a protective glove. In contrast to FIGS. 1 and 2, FIG. 3 shows an embodiment of the invention wherein a base 7 is adapted solely for use when incorporated into a glove 50. The base 7 comprises two relatively short legs 7*a* and 7*b* disposed in a Y-shape, abutting the support 2 at a point approximately located behind the lower knuckle of the thumb. The legs 7*a* and 7*b* abut the support 2 at an angle adapted to conform comfortably to the outer surfaces of the thumb and wrist. The thumb protector of FIG. 3 can be mated with glove 50 in any of a number of ways; the legs 7*a* and 7*b* may be inserted into pockets formed on the inner surface of the glove 50, the legs 7*a* and 7*b* may be sewn, stapled or glued to the glove 50, etc. When anchored into a glove, the base 7 suitably supports the cap support 2 and cap 1 to provide protection to the thumb by cushioning and absorbing in the body of the glove any shock directed along a longitudinal axis of the thumb.

A variation in the structure of the cap may be employed with any of the above-described support and base structures. The variation, shown in FIG. 4, includes a rigid loop 8 connected to the support 2, which loop, when in use, extends circumferentially about the thumb with a longitudinal axis near to, or coinciding with, a longitudinal axis of the thumb. The loop 8 abuts a U-shape component 9 extending over the tip of the thumb. While the U-shape component 9 provides less extensive coverage than cap 1, it nevertheless extends, in use, 360 degrees about an extension of a longitudinal axis of the thumb.

Figure 5C:
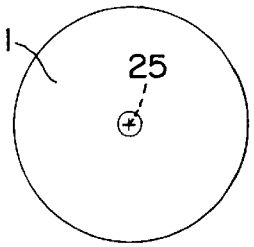
FIGS. 5A and 5C are isometric and top views, respectively, of the embodiment of FIG. 1 which are useful in completing the description of the invention.
Figure 5D:
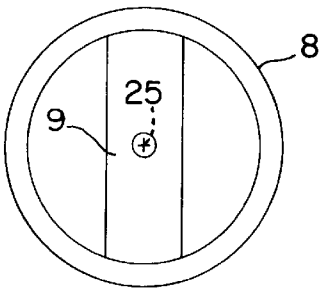
FIGS. 5B and 5D are isometric and top views, respectively, of the embodiment of FIG. 4 which are useful in completing the description of the invention.
Figure 5A:
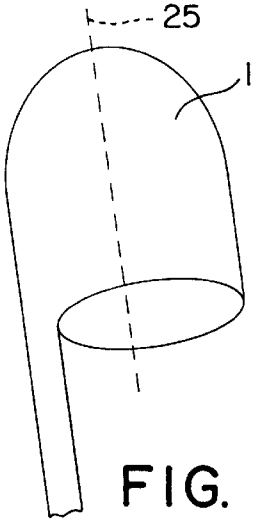
Figure 5B:
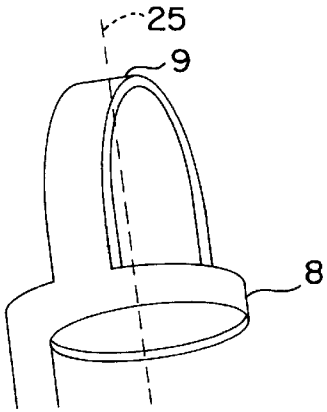
Figure 4:
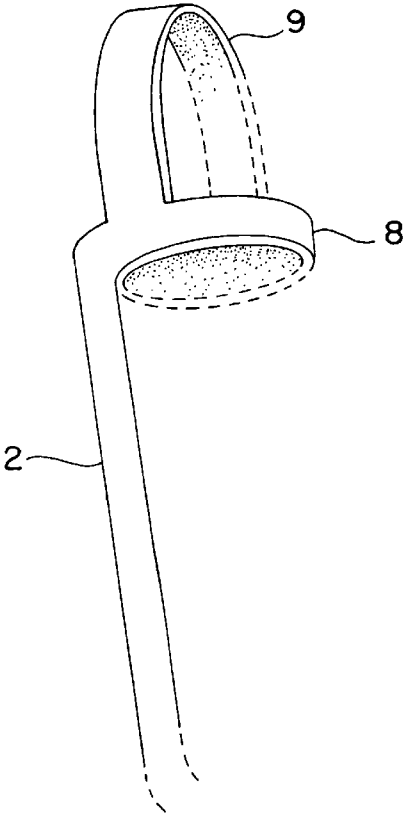
FIG. 4 is an isometric view of an embodiment of the invention showing a variation in the structure of the cap.

The similarity of the caps of FIGS. 1 and 4 in this latter respect can be seen in FIGS. 5A–5D. More particularly, FIGS. 5A and 5C relate to the cap 1 of FIG. 1. As seen in FIGS. 5A and 5C, the axis 25, which represents an extension of a longitudinal axis of a user's thumb, intersects the cap 1 in a location where the cap 1 surrounds the axis 25 through substantially 360 degrees. From FIGS. 5B and 5D, the reader can see that the same relationship exists with respect to the very different cap 8–9 of FIG. 4. While there is a greater surface to the cap 1 as opposed to the cap 8–9 of FIG. 4, nevertheless, in the important location surrounding the intersection of the cap and longitudinal axis of the user's thumb, both caps have protective material.

The foregoing embodiments may be constructed by fusing, casting or machining the separately-described elements of cap, cap support and base into a unitary or discrete structure of Teflon™, plastic, steel, or other rigid material.

Figure 6:
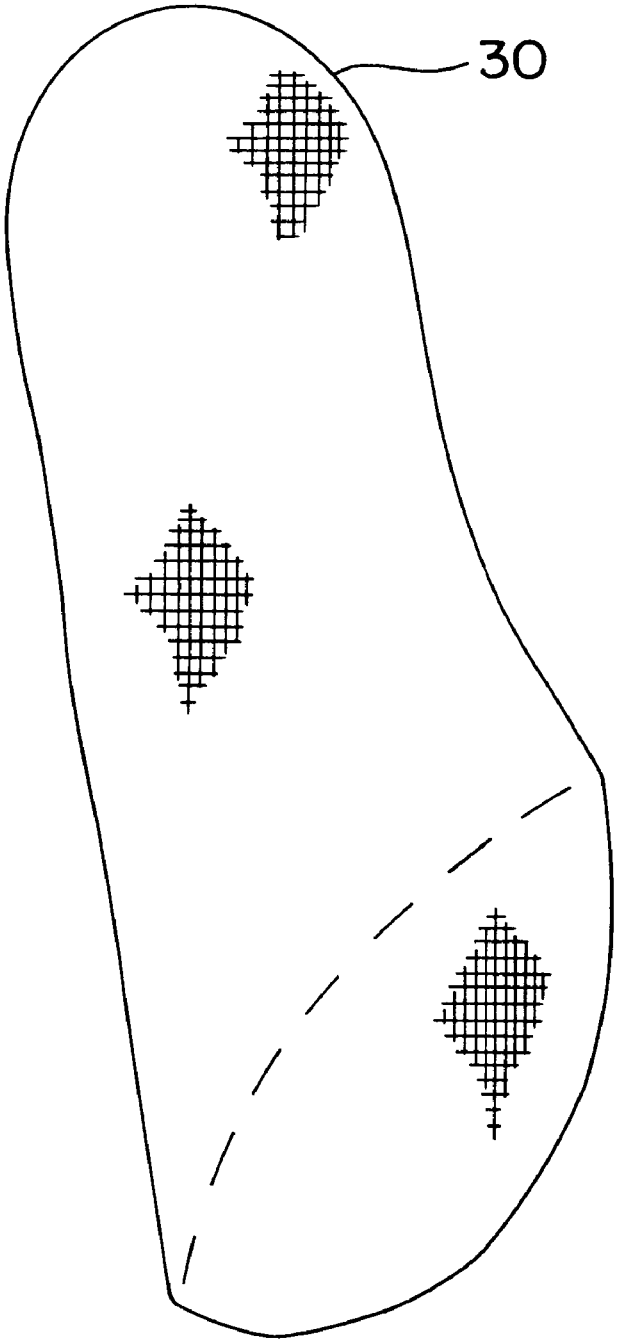
FIG. 6 shows isometric view of an embodiment of a sleeve for the thumb protector for retaining the thumb within the protection of the cap.

Turning now to FIG. 6, there is shown an embodiment of a sleeve 30 for the thumb protector for retaining the thumb within the protection of the cap. The sleeve 30 may be made of a flexible material which, for ease of depiction, is shown as webbing or netting, but the flexible material may be continuous in form, such as in cloth, or may comprise sections of continuous material alternating with open space or with webbed material.

Figure 7:
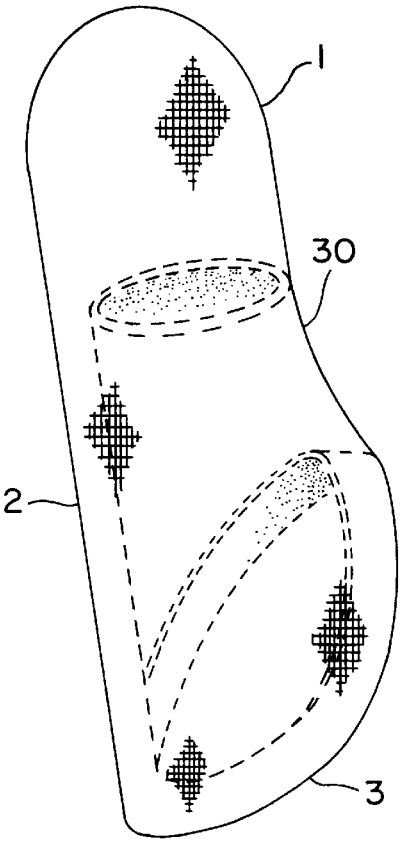
FIG. 7 shows an isometric view of an embodiment of a sleeve for the thumb protector wherein the sleeve is adapted to fit snugly over the outer surfaces of the thumb protector to retain the thumb within the protection of the cap.

FIG. 7 shows the embodiment of FIG. 6 in use on a thumb protector. As can be seen, the sleeve 30 is adapted to fit snugly over the thumb protector to retain the thumb within the protection of the cap.

Figure 8:
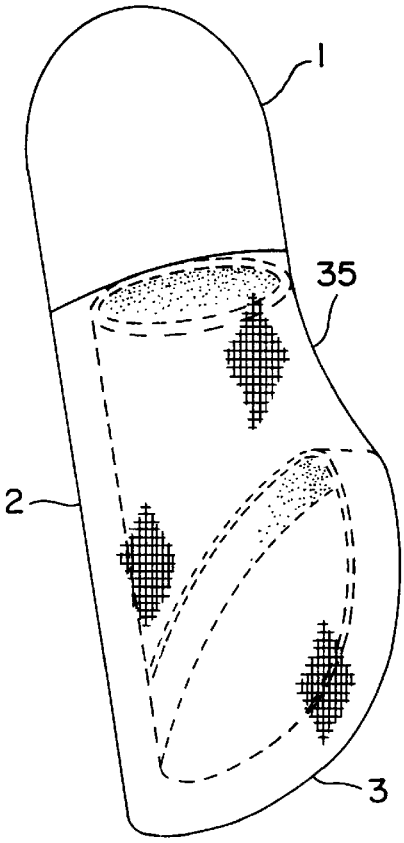
FIG. 8 shows an isometric view of an embodiment of a sleeve for the thumb protector wherein the sleeve is fastened between the cap and the base to retain the thumb within the protection of the cap.
Figure 9:
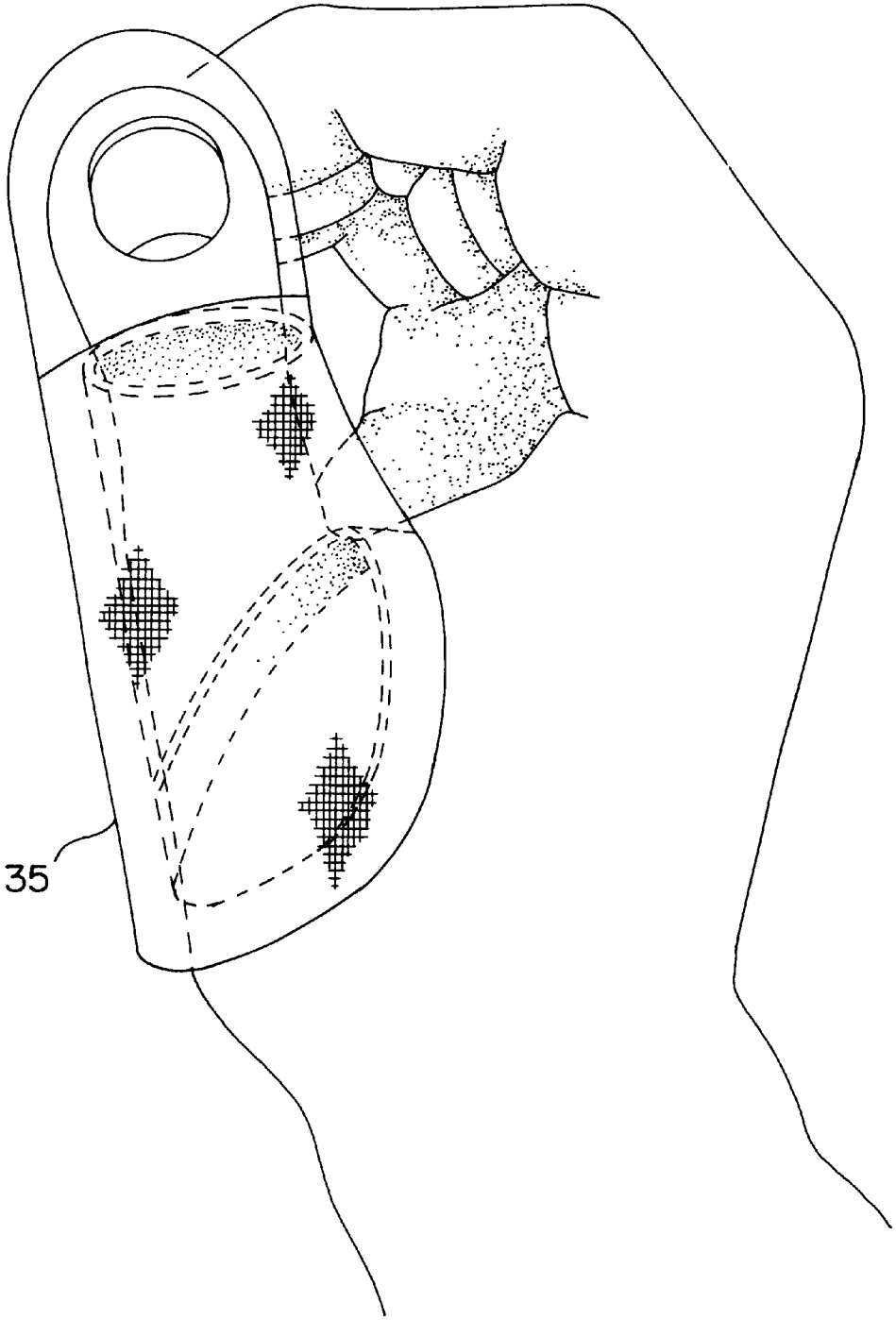
FIG. 9 shows the embodiment of FIG. 8 in use on a hand.

FIG. 8 shows an embodiment of a sleeve 35 for the thumb protector wherein the sleeve is fastened between the cap 1 and the base 3. As can be seen, in this configuration the sleeve 35 acts to retain the thumb within the protection of the cap 1. FIG. 9 shows the embodiment of FIG. 8 in use on a hand.

It may be readily seen from the disclosed embodiments that the objects of the invention are met. The cap surrounding the tip of the thumb affords protection from impact directly to the tip of the thumb, particularly in a direction substantially parallel to a longitudinal axis of the thumb, and transfers the shock of impact along the support to the base, to be absorbed by the palm, hand or glove without injury. Moreover, the position of the support member along the outer portion of the thumb both protects the thumb from lateral shock and permits the player to grip the shaft of the player's stick without substantial interference from protective structures. Finally, the sleeve retains the thumb within the protection of the cap.

We claim:

1. A thumb protector comprising:

a cap, a cap support and base means, the base means adapted to engage the hand near an interphalangeal joint adjacent a root of the thumb for absorbing and transferring, to the hand, the shock of an impact to the thumb, the cap support connected between the base means and the cap, the cap comprising a rigid shell extending, when in use, above the top of the thumb and extending for 360 degrees about an extension of a longitudinal axis of the thumb.

2. The thumb protector of claim 1 wherein the cap comprises a continuous form comprising a covered cylinder.

3. The thumb protector of claim 1 wherein the cap includes a first rigid loop connected to the support and, when in use, extending circumferentially about the thumb with a longitudinal axis near to or coinciding with a longitudinal axis of the thumb, and the rigid shell is of U-shape with legs, when in use, substantially parallel to a longitudinal axis of the thumb.

4. The thumb protector of any of claims 1–3 wherein the base means has the form of a closed loop, when in use, surrounding the root of the thumb.

5. The thumb protector of any of claims 1–3 wherein the base means is of U-shape with a first leg and a second leg, when in use one leg abutting a back surface of the hand and the second leg abutting at least the palm of the hand near the interphalangeal joint adjacent the root of the thumb.

6. A glove including a thumb protector as recited in claim 4.

7. A glove including a thumb protector as recited in claim 5.

8. The glove of claim 7 wherein the cap support is rigid.

9. The thumb protector of claim 1, further including a sleeve comprising flexible material, when in use, interposed between the thumb and base means in a region outside the cap, for retaining the thumb within the cap.

10. The thumb protector of claim 1 wherein the cap support is rigid.

11. A glove comprising a thumb protector including a cap and cap support means, the cap support means engaging and supported by the glove and connected to the cap for transferring, to the glove, the shock of an impact to the thumb, the cap comprising a rigid shell extending, when in use, above the top of the thumb and extending for 360 degrees about an extension of a longitudinal axis of the thumb.

12. The glove of claim 11 wherein the cap comprises a continuous form comprising a covered cylinder.

13. The glove of claim 11 wherein the cap further includes a first rigid loop, when in use, extending circumferentially about the thumb with a longitudinal axis near to or coinciding with a longitudinal axis of the thumb, and the rigid shell is of U-shape with legs, when in use, substantially parallel to a longitudinal axis of the thumb.

14. The glove of claim 11 wherein the cap support means further includes a base having legs engaging and being supported by the glove.

15. The glove of claim 14 wherein the cap support means includes a rigid support.

* * * * *